US006431774B1

(12) United States Patent
Matsumoto

(10) Patent No.: US 6,431,774 B1
(45) Date of Patent: Aug. 13, 2002

(54) PRINTER, CONTROL METHOD FOR THE SAME, AND DATA STORAGE MEDIUM FOR RECORDING THE CONTROL METHOD

(75) Inventor: Yoshiharu Matsumoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/505,620

(22) Filed: Feb. 16, 2000

(30) Foreign Application Priority Data

Feb. 19, 1999 (JP) ..... 11-041679

(51) Int. Cl.[7] ..... B41J 33/14
(52) U.S. Cl. ..... 400/225; 400/120.01; 400/234
(58) Field of Search ..... 400/225, 76, 70, 400/61, 234, 223, 120.01

(56) References Cited

U.S. PATENT DOCUMENTS

| | | | | |
|---|---|---|---|---|
| 4,653,939 A | | 3/1987 | Hibino | |
| 4,712,931 A | * | 12/1987 | Ohshima | 400/196.1 |
| 5,219,233 A | * | 6/1993 | Bauerle et al. | 400/124.02 |
| 5,357,270 A | * | 10/1994 | Herbert | 347/211 |
| 5,360,279 A | * | 11/1994 | Asai et al. | 400/211 |
| 5,468,078 A | * | 11/1995 | Asai et al. | 400/124.09 |
| 6,231,249 B1 | * | 5/2001 | Harris | 400/188 |
| 6,315,471 B1 | * | 11/2001 | Hsieh et al. | 347/172 |

FOREIGN PATENT DOCUMENTS

| | | |
|---|---|---|
| EP | 0 552 486 | 7/1993 |
| JP | 60-141581 | 7/1985 |
| JP | 62-051473 | 3/1987 |
| JP | 5-131736 | 5/1993 |
| JP | 5-147338 | 6/1993 |
| JP | 6-087256 | 3/1994 |
| JP | 6 087256 | 3/1994 |
| JP | 8-207405 | 8/1996 |

* cited by examiner

*Primary Examiner*—Andrew H. Hirshfeld
*Assistant Examiner*—Charles H. Nolan, Jr.
(74) *Attorney, Agent, or Firm*—Mark P. Watson

(57) ABSTRACT

Problems relating to shifting and misalignment of an ink ribbon relative to the print head as a result of changing the color used for printing with a multi-color ink ribbon are eliminated with the least possible reduction in printing throughput. The ink ribbon 13 can be wound in conjunction with print head 14 movement, and has a plurality of ink colors arranged in a direction perpendicular to the ribbon winding direction. Switching mechanisms 30 and 40 change the relative position between the print head 14 and the ink ribbon 13 in the directional perpendicular to the ink ribbon winding direction. If, after a switching mechanism changes the ink color selection, the distance l of print head movement to the next print start position accompanied by ink ribbon winding is less than a specific distance L needed to correct any misalignment of the ribbon to the print head, the controller moves the print head in a non-printing winding mode a distance of at least L−l to wind the ribbon.

12 Claims, 9 Drawing Sheets

PRINTER, CONTROL METHOD FOR THE SAME, AND DATA STORAGE MEDIUM FOR RECORDING THE CONTROL METHOD

BACKGROUND OF THE INVENTION

1. Field of the Invention

The present invention relates to a printer having a multi-color ribbon which has a plurality of ink colors arrayed substantially orthogonally to the ribbon winding direction, and to a control method for the printer. More specifically, the present invention relates to a printer in which winding of the ink ribbon is performed in conjunction with moving a carriage on which the print head is carried, and to a control method for the printer.

2. Description of the Related Art

Printers that use an ink ribbon cartridge continue to be widely used due to their high printing reliability and relatively low cost. When a cartridge is loaded into the printer, the ribbon that is pulled out from the cartridge is positioned in the gap between the print head and paper along the path of print head movement. A winding mechanism inside the cartridge gradually winds the ink ribbon in conjunction with movement of the carriage and print head, and thus maintains a fresh section of the ink ribbon disposed in the print head-paper gap.

The ribbon used in this type of printer has a plurality of colors of ink arrayed across the width of the ink ribbon, that is, in the direction orthogonal to the ink ribbon winding direction. Such a ribbon is referred to below as a multi-color ink ribbon. By changing the relative positions of the ink ribbon and the print head in this widthwise direction, it is possible to print in multiple colors. That is, when a command for printing in a specific color accompanies the print command, the printer controller moves the position of the ink ribbon relative to the print head, or the position of the print head relative to the ribbon, so as to bring the desired color on the ink ribbon in front of the print head. Then, the print head is driven to print.

Such printers have, however, suffered from one common problem. When changing the relative position of the ink ribbon to the print head, the ink ribbon can catch on the face or edge of the print head, resulting in the desired color area on the ink ribbon (referred to also below as the print track) not being correctly positioned in front of the print head. Thus, there is a misalignment between the ink ribbon and the print head. The result is that the desired color is not used for printing immediately after changing the color position of the ribbon, and the desired color gets mixed with another color.

An arm of the cartridge normally keeps a specific tension on the ink ribbon, and thus alleviates the problem of the ribbon getting caught. Over time, however, the arm tension tends to weaken, or the ink ribbon gets slightly twisted or off track in the direction of its width, and the above-noted problem occurs.

Proposed solutions for this problem include various methods of winding the ink ribbon a specific distance after changing the relative positions of the print head and ribbon so as to move the ink ribbon to the desired position, that is, properly align the ribbon with the print head.

For example, Japanese Unexamined Patent Application Publication (kokai) 6-87256 teaches a color mixing prevention device for a printer. This device winds a specific length of ribbon either while shifting the position of the ink ribbon or after the ink ribbon has been shifted to remove slack from the ribbon and move the ribbon to the correct position.

Japanese Unexamined Patent Application Publication (kokai) 8-207405 teaches a printer for positively removing ink ribbon slack by changing the amount of ink ribbon that is wound according to the distance the ink ribbon is shifted to change its position.

Japanese Unexamined Patent Application Publication (kokai) 5-131736 teaches a printer designed to drive a ribbon winding mechanism using a carriage motor for bidirectionally moving the carriage. A ribbon shifting motor is driven to shift the ribbon position while the carriage motor is accelerating or decelerating as a way of preventing ink ribbon jams and enabling high-speed printing.

However, a problem common to the above-noted methods of the related art is that printing throughput declines after changing the print color (i.e., the position of the ink ribbon). More specifically, the following process is typically performed when a command specifying a color different from the previous color is sent to the printer.

(1) Change the relative positions of the print head and ink ribbon.

(2) Wind the ribbon a specific distance (this can be done simultaneously with step (1) above).

(3) Move the print head to the print start position.

(4) Print.

However, this process may be wasteful in a printer in which the ink ribbon is wound in conjunction with moving the carriage on which the print head is carried. For example, moving the print head to the print start position in step (3) may, as a result of carriage movement and depending upon the location of the next print position, sufficiently wind the ink ribbon to correct any offset or misalignment of the ribbon position. In this case the time spent performing step (2) above is unnecessary. In addition, excess ribbon is wound and thus wasted.

OBJECTS OF THE INVENTION

Therefore, it is an object of the present invention to overcome the aforementioned problems.

Considering the above disadvantages in the related art, it is an object of the present invention to provide a printer and a control method for the same whereby problems relating to an offset in the ink ribbon position when changing the ink ribbon color can be eliminated as much as possible without reducing printing throughput.

SUMMARY OF THE INVENTION

To achieve above objects, the present invention provides a printer having a print head that moves relative to a print medium; an ink ribbon disposed in front of the print head along the direction of print head movement such that the ink ribbon is wound in conjunction with print head movement. The ink ribbon has a plurality of ink colors arranged substantially orthogonally to the direction in which the ink ribbon is wound. A switching mechanism is provided for switching the position of the print head relative to the ink ribbon in a direction orthogonal to the ink ribbon winding direction. A controller moves the print head in a non-printing winding mode a distance L−l after the relative position of the print head to ribbon is switched by the switching mechanism when distance l of print head movement in conjunction with ink ribbon winding to the next print start position is less than a specific distance L for correcting ink ribbon offset to the print head.

It should be noted that this non-printing winding mode as used herein involves moving the print head while winding the ink ribbon without driving the print head to print for the purpose of correcting misalignment of the ink ribbon with the print head.

When thus comprised the print head is moved in this non-printing winding mode only when moving the print head in conjunction with ink ribbon winding will not wind the ink ribbon the required distance to correct misalignment. As a result, a reduction in print throughput accompanying switching the ink ribbon position can be minimized.

The controller in this printer preferably determines the position of the print head after being moved in the non-printing winding mode based on the next print start position.

This makes it possible to minimize the time required to move the print head to the next print start position when non-printing winding mode movement of the print head is necessary.

Yet further preferably, the ink ribbon is wound in conjunction with print head movement in only one direction, and the switching mechanism switches when the print head is outside the printable area of the print head.

Another printer according to the present invention for achieving the above object is a printer for printing using an ink ribbon having a plurality of print tracks with the printer comprising: a print head for printing with the ink ribbon on a print medium; a moving mechanism for bidirectionally moving the print head in a direction across a print medium transportation direction; a winding mechanism for winding the ink ribbon in conjunction with print head movement; a shift mechanism for changing the position of the print track relative to the print head; and a controller for determining, after switching by said switching mechanism starts, whether a distance l is equal to a specific distance L, and moving the print head in a non-printing winding mode a distance L–l to wind the ink ribbon when print head movement distance l is less than specific distance L. This print head movement distance l is the distance of print head movement to the next print start position accompanied by ink ribbon winding. This non-printing winding mode is as noted above.

This printer according to the present invention determines the distance and direction of print head in the non-printing winding mode based on the next print start position and the printing direction.

The present invention also achieves the above object by providing a printer control method. This control method applies to a printer comprising a print head that moves relative to a print medium; an ink ribbon disposed in front of the print head along a direction of movement of the print head, the ink ribbon being wound in conjunction with print head movement and having a plurality of ink colors arranged substantially orthogonally to this winding direction; and a switching mechanism for switching the position of the print head relative to the ink ribbon in a direction orthogonal to the ink ribbon winding direction. The control method comprises the following steps: changing the position of the print head relative to the ink ribbon by means of the switching mechanism; comparing a distance l and a specific distance L, and moving the print head at least a distance L–l in a non-printing winding mode if distance l is less than specific distance L. Distance l as used herein is the distance of print head movement to the next print start position with the ink ribbon being wound as the print head moves, and specific distance L is the distance for correcting misalignment of the ink ribbon to the print head, typically as a result of shifting the relative position of the print head to the ribbon. The non-printing winding mode is as described above.

A further control method according to the present invention is a printer control method for a printer for printing using an ink ribbon having a plurality of print tracks. This control method comprises: printing on a print medium with the ink ribbon using a print head; moving the print head bidirectionally on a path crossing the direction in which the print medium is transported; winding the ink ribbon in conjunction with print head movement; changing the position of the print track relative to the print head; determining whether a distance l is equal to a specific distance L after or during changing the ribbon to print head alignment, and moving the print head in a non-printing winding mode a distance L–l to wind the ink ribbon when print head movement distance l is less than specific distance L based on the result of the determining step. This distance l is also the distance of print head movement to the next print start position accompanied by ink ribbon winding, and the non-printing winding mode is as noted above.

This second method further preferably comprises a step for deciding the nonprinting winding mode distance and direction based on the next print start position and print direction.

The control method of the present invention can also be provided as a control program executable by a printer controller, and can be provided by a data storage medium on which the control program is recorded. Storage media and devices that can be used for this data storage medium of the invention include: memory, Compact Discs, particularly CD-ROM media; floppy disks; hard disks; magneto-optical disks; DVD media such as DVD-ROM discs; and magnetic tape. Furthermore, these media can be used to supply this control program to existing printers. Yet further, the program can be made available on a World Wide Web (WWW) site from which users can download the program for use with an existing printer.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

DESCRIPTION OF THE PREFERRED EMBODIMENTS

The preferred embodiments of the present invention are described below with reference to the accompanying figures.

Figure 1:
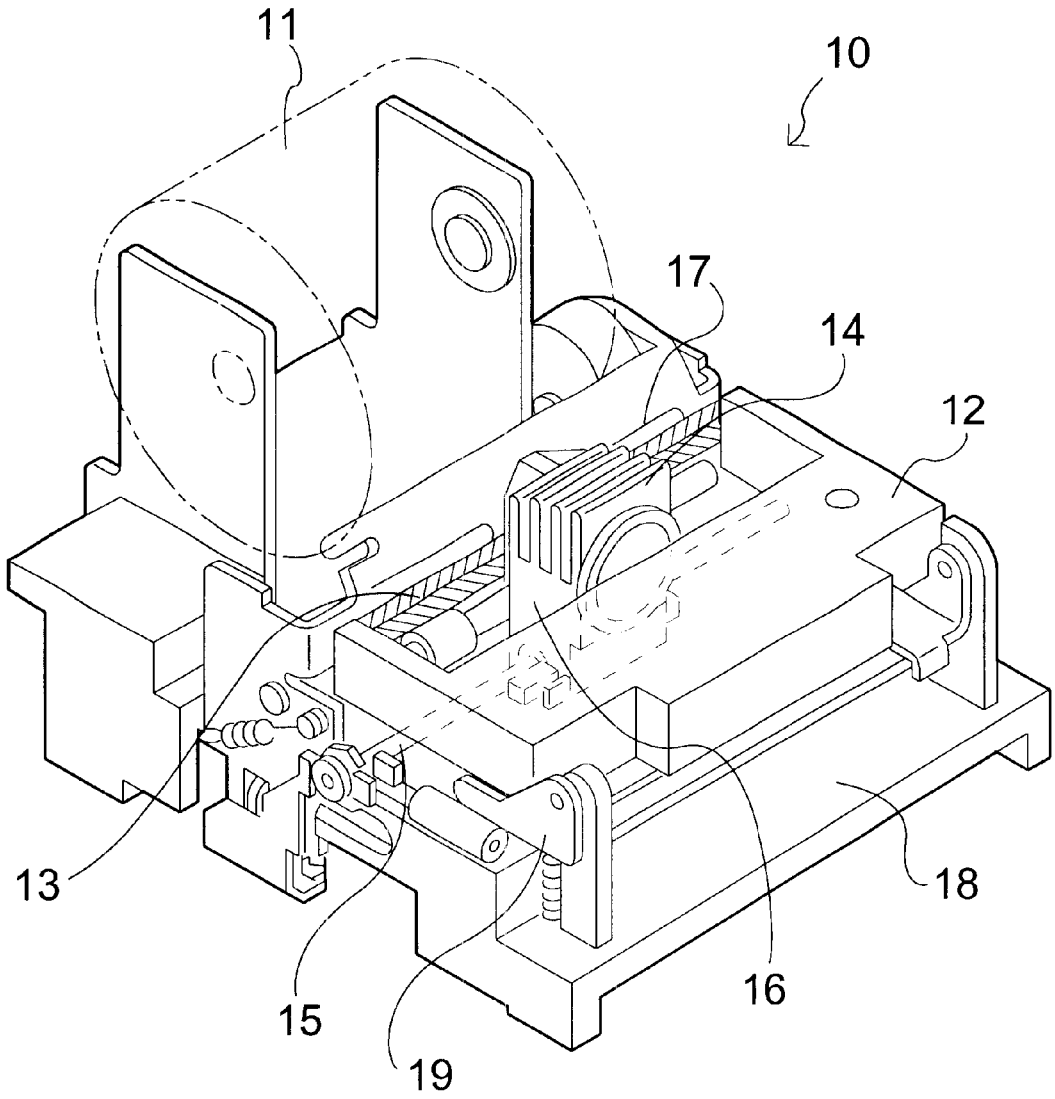
FIG. 1 is an external perspective view showing a printer according to the present invention.
Figure 2:
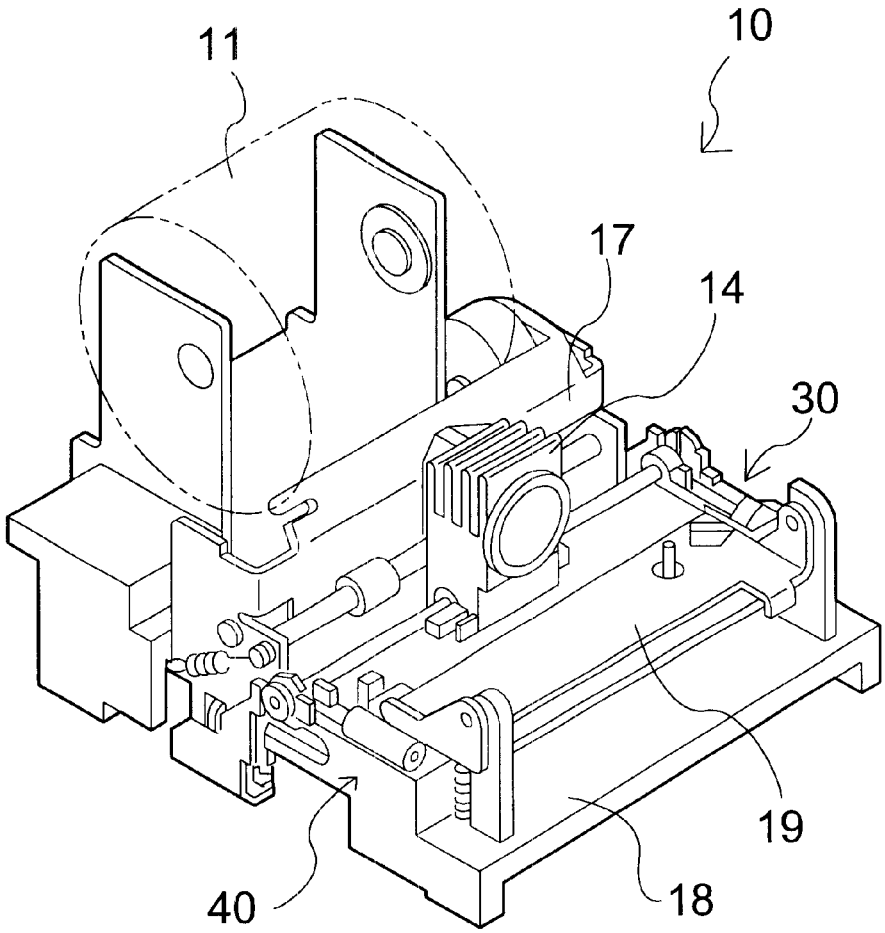
FIG. 2 shows the same printer in FIG. 1 but with the ink ribbon cartridge removed.

FIG. 1 is an external overview of a printer 10 according to the present invention, and FIG. 2 is the same as FIG. 1 except that the ink ribbon cartridge has been removed.

A printer 10 according to this exemplary embodiment of the present invention is a dot impact printer for printing on roll paper 11 contained in the printer, and uses a replaceable ink ribbon cartridge 12 as the ink supply source. The print head 14 is mounted on a carriage 16 that is guided on a shaft 15. The carriage 16, and thus print head 14, travels in a direction transverse to the feed direction of the roll paper 11 to print on the roll paper disposed between the head and the platen 17. The carriage 16 is linked to a timing belt 57 (see FIG. 5) whereby power is transferred from the carriage drive motor 54 (see again FIG. 5) to the carriage to transport the print head 14 along the shaft 15.

The ink ribbon cartridge 12 comprises a multi-color ink ribbon 13 having black and red ink areas formed substantially parallel to the length of the ribbon so that two-color printing is possible by changing the area of the ribbon (i.e., the print track) opposing the print head 14. That is, the ink ribbon cartridge 12 is mounted on a frame 19 removably supported such that it can pivot on the base frame 18 of the printer. When the angle of the frame 19 relative to the base frame 18 is changed by the shift mechanism 30 or shift release mechanism 40, further described below, to switch the color, the position of the ink ribbon cartridge 12 mounted on the frame 19 is changed relative to the print head 14. This places either the black or red ink portion of the multi-color ink ribbon 13 opposite the impact area of the print head 14. By then holding this position while printing, it is possible to print in a desired color.

It should be noted that in the default position the frame 19 is such that it is held substantially horizontal so that the black ink portion of the multi-color ink ribbon 13 is opposite the printing portion of print head 14 and printing in black is achieved.

Figure 3:
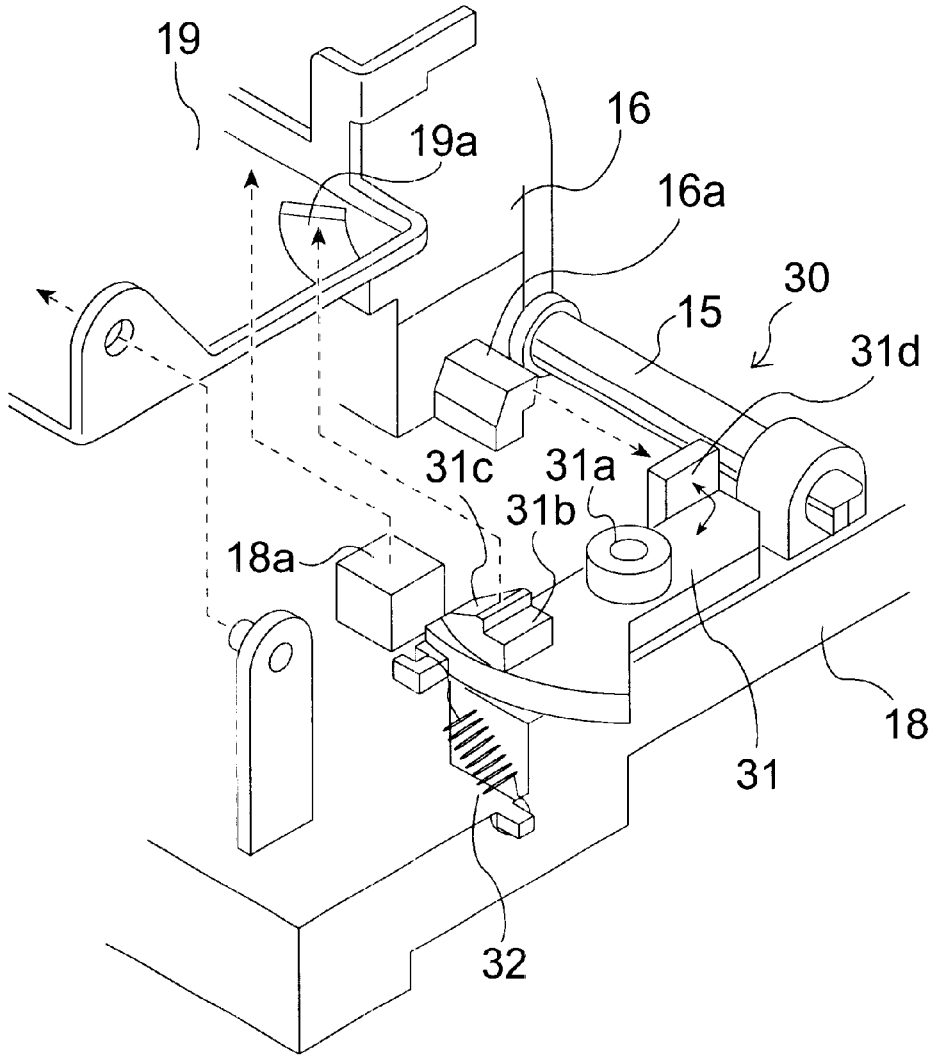
FIG. 3 is a side, perspective view of the shift mechanism disposed at the right end of the print head movement area in the printer shown in FIG. 1 when viewed as shown in FIGS. 1 or 2.
Figure 4:
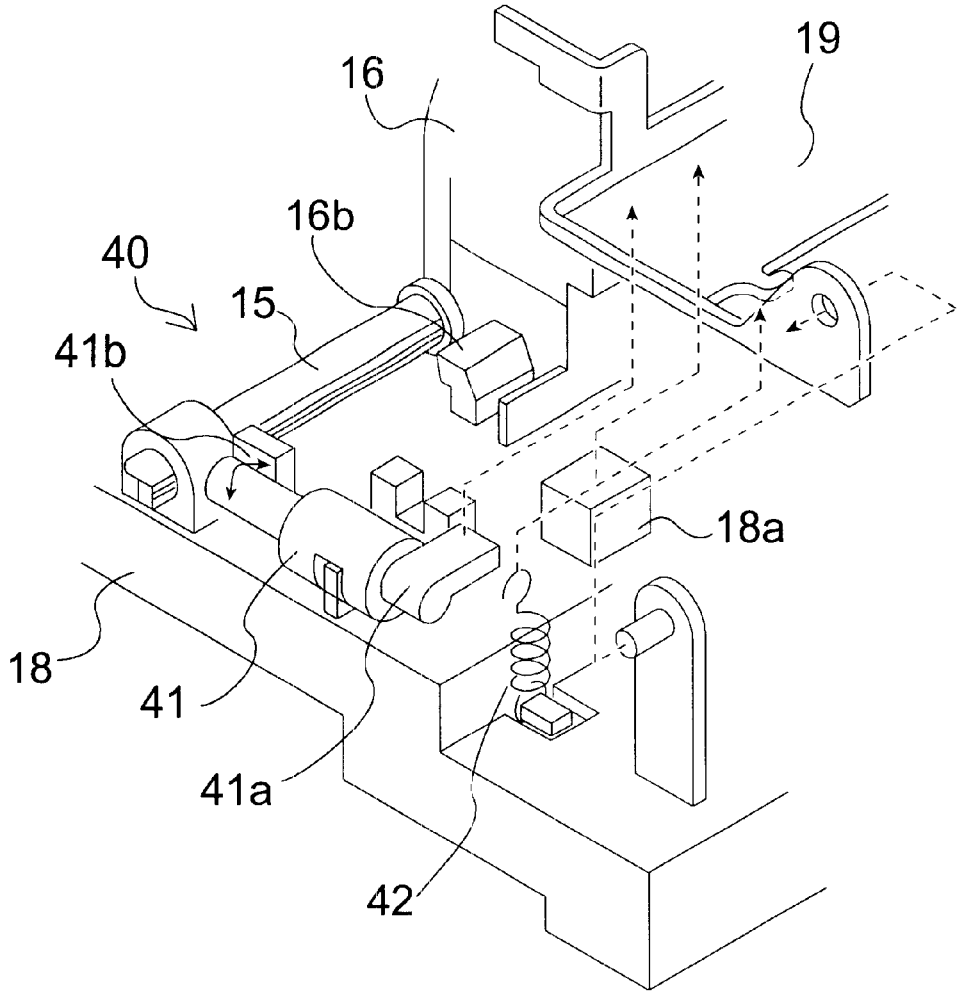
FIG. 4 is a side, perspective view of the shift release mechanism disposed at the left end of the print head movement area in the printer shown in FIG. 1 when viewed as shown in FIGS. 1 or 2.

The shift mechanism that enables the printer shown in FIG. 1 to change ribbon color (i.e., the print track of the ink ribbon 13) is described next with reference to FIG. 3 and FIG. 4. FIG. 3 is a side, perspective view of the shift mechanism 30 disposed at the right end of the area of print head 14 movement, and FIG. 4 is a side, perspective view of the shift release mechanism 40 disposed at the left end of the print head 14 movement area, when the printer 10 is viewed as shown in FIGS. 1 or 2.

The shift mechanism 30 is activated when the print head 14 moves to the right end beyond the right margin of the printing area, thus causing the shift mechanism 30 to slightly tilt the frame 19 and ink ribbon cartridge 12 from the default state. This puts the red ink area of the multi-color ink ribbon 13 opposite impact area of the print head 14 to enable printing in red.

As shown in FIG. 3, the shift mechanism 30 has a lifting arm 31 at the bottom on the right end of the frame 19. This lifting arm 31 is rotatively supported such that it can pivot freely on a stud 31*a* in a horizontal plane with respect to the base frame 18. Lifting arm 31 is held in the default position, as shown in FIG. 3, by spring 32. A step 31*b* with an engaging claw 31*c* is formed on the top of lifting arm 31. When the lifting arm 31 is in the default position, this step 31*b* is positioned at the side of the frame 19. The other end of the lifting arm 31 has a stop 31*d* that is contacted by the protrusion 16*a* on carriage 16. When a command to change the print color from black to red is received, causing the carriage 16 to move to the right end outside the print area, the protrusion 16*a* pushes against stop 31*d*, causing the lifting arm 31 to rotate in the clockwise direction about stud 31*a*.

In the default state, the frame 19 is placed with the side thereof next to the pivot point of the lifting arm 31, and rests on a pedestal 18*a* on the base frame 18, and is thereby held substantially level. The top of the step 31*b* on lifting arm 31 is positioned higher than the top of pedestal 18*a*. When the lifting arm 31 pivots on the stud 31*a*, it causes the step 31*b* to move under the frame 19 using the cam surface of the engaging claw 31*c*. The step 31*b* lifts up this extension of frame 19, causing the frame 19 to rotate upwardly about its support point. The engaging claw 31*c* of the lifting arm 31 engages hole 19*a* formed in the frame 19, and thereby holds the frame 19 in this tilted state even after the carriage 16 moves back toward the left side.

This upward movement of the frame 19 brings the red ink area of the multi-color ink ribbon 13 in ink ribbon cartridge 12 in front of the impact part of the print head 14 so that printing in red is possible.

The shift release mechanism 40 is activated when the print head 14 moves to the left end beyond the left margin of the printing area. The shift release mechanism 40 functions to return the frame 19, and therefore the ink ribbon cartridge 12, to the original default position from the shift position set by the shift mechanism 30. After this shift release operation, the black ink area of the multi-color ink ribbon 13 is opposite the impact part of print head 14 so that the printer can print in black.

As shown in FIG. 4, the shift release mechanism 40 has an engagement release 41 disposed at the bottom on the left end of the frame 19. This release 41 is rotatively supported so that it can turn on the base frame 18, and comprises at one end a lever 41*a* that operates in conjunction with rotation of the release 41, and on the other end a stop 41*b* for contacting protrusion 16*b* of the carriage 16. The lever 41*a* is located on the bottom below the extension of frame 19 so that when it operates, the lever 41*a* contacts and lifts up on the bottom of the frame 19. A spring 42 is connected between the base frame 18 and the frame 19 to ensure smooth movement of the frame 19.

The ink ribbon cartridge 12 is set to the shift position by the shift mechanism 30, as described above, so that the frame 19 is inclined to permit printing in red. If a command is then received to change the print color from red to black, the carriage 16 is carried to the left end outside the print area, and the protrusion 16*b* contacts the stop 41*b* of the engagement release 41. This causes the release 41 to rotate and the end of the lever 41*a* to lift up, thus causing the frame 19, which is already raised to an inclined position, to rise further. This releases the engaging claw 31*c* of the shift mechanism 30 from the hole 19*a* in frame 19 and returns it to the default position under the force of spring 32, allowing the frame 19 to return to the default horizontal position. The black ink area of the multi-color ink ribbon 13 of ink ribbon cartridge 12 is thus situated in front of the impact part of print head 14 and the printer can print in black.

Figure 5:
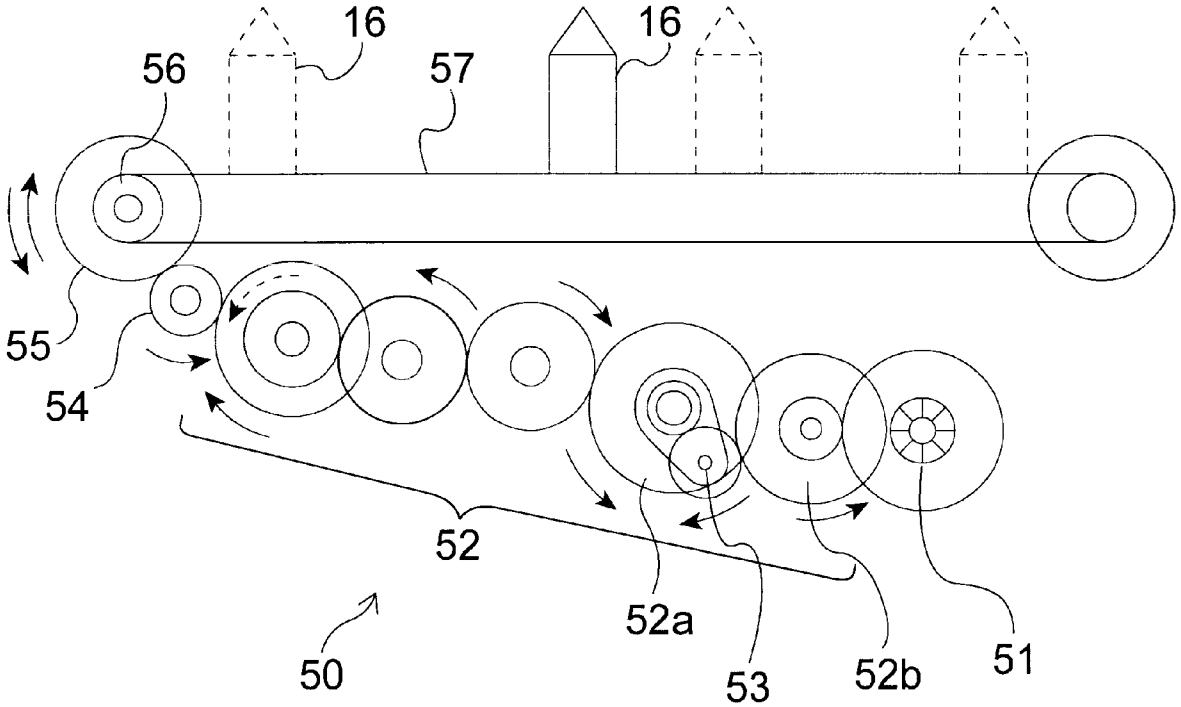
FIG. 5 shows the typical configuration of an ink ribbon winding mechanism in the printer in FIG. 1.

The ink ribbon winding mechanism is described next. FIG. 5 shows the basic configuration of an ink ribbon winding mechanism 50 in a printer according to the present invention.

As shown in FIG. 5, a drive shaft 51 for winding the ink ribbon is linked by intervening gear set 52 to a carriage drive motor 54. Gear 52*a* of the gear set 52 has a coaxial rocker gear 53. When gear 52*a* is turned counterclockwise, rocker gear 53 meshes with and transfers power to gear 52*b*. When gear 52*a* is turned clockwise, the rocker gear 53 separates from gear 52*b* and gear 52*a* turns freely.

The carriage drive motor 54 engages gear 55 fixed to pulley 56, and the carriage drive motor 54 thereby drives timing belt 57 mounted on pulley 56 in forward or reverse. A carriage 16 linked to the timing belt 57 is thus transported in a direction approximately orthogonal to the paper feed direction.

If the carriage drive motor 54 is driven counterclockwise, the carriage 16 travels from left to right in the case shown in FIG. 5. Drive power from the carriage drive motor 54 is passed by way of gear set 52 to the ink ribbon drive shaft 51. As a result, the ink ribbon is wound little by little in conjunction with timing belt 57 movement.

If the carriage drive motor 54 is driven clockwise, the carriage 58 travels from right to left. In this case, however, the rocker gear 53 disengages from gear 52*b*, power is therefore not transferred from the carriage drive motor 54 to the ink ribbon drive shaft 51, and the ink ribbon is not wound.

It will thus be evident that a printer according to the present invention winds the ink ribbon only when the carriage moves in one direction.

Figure 6:
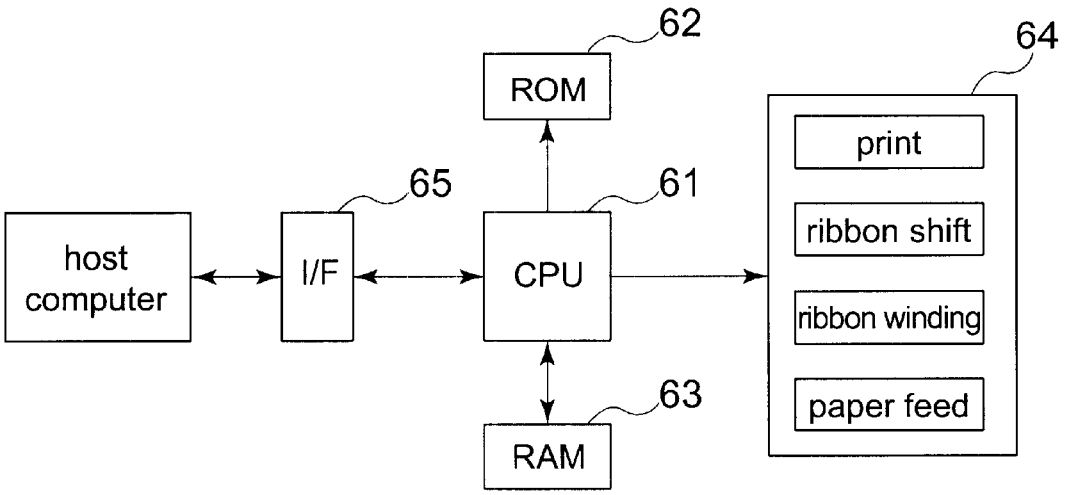
FIG. 6 is a block diagram of a control device in a printer according to the present invention.

Print control in a printer according to this preferred embodiment is described next. FIG. 6 is a block diagram of a control device for controlling the mechanical components of a printer according to this preferred embodiment of the invention.

Referring to FIG. 6, the central processing unit (CPU) 61 controls overall printer operation in accordance with data and a control program stored in read only memory (ROM) 62. The print unit 64 controlled by the CPU 61 includes a print mechanism, ribbon shift mechanism, ribbon winding mechanism, and paper transportation mechanism. Commands and print data from a host computer or device are received through an interface (I/F) 65 and temporarily stored in random access memory (RAM) 63. It should be noted that RAM 63 has separate buffers or distinctly addressable areas for storing the currently selected print color and various other settings or data. Further, the control method of the present invention may be stored on a data storage medium other than ROM 62, such as Compact Discs, particularly CD-ROM media; floppy disks; hard disks; magneto-optical disks; DVD media such as DVD-ROM discs; and magnetic tape. Furthermore, these media can be used to supply this control program to existing printers. Yet further, the program can be made available on a World Wide Web (WWW) site from which users can download the program for use with an existing printer through a host computer and/or interface 65.

Figure 7:
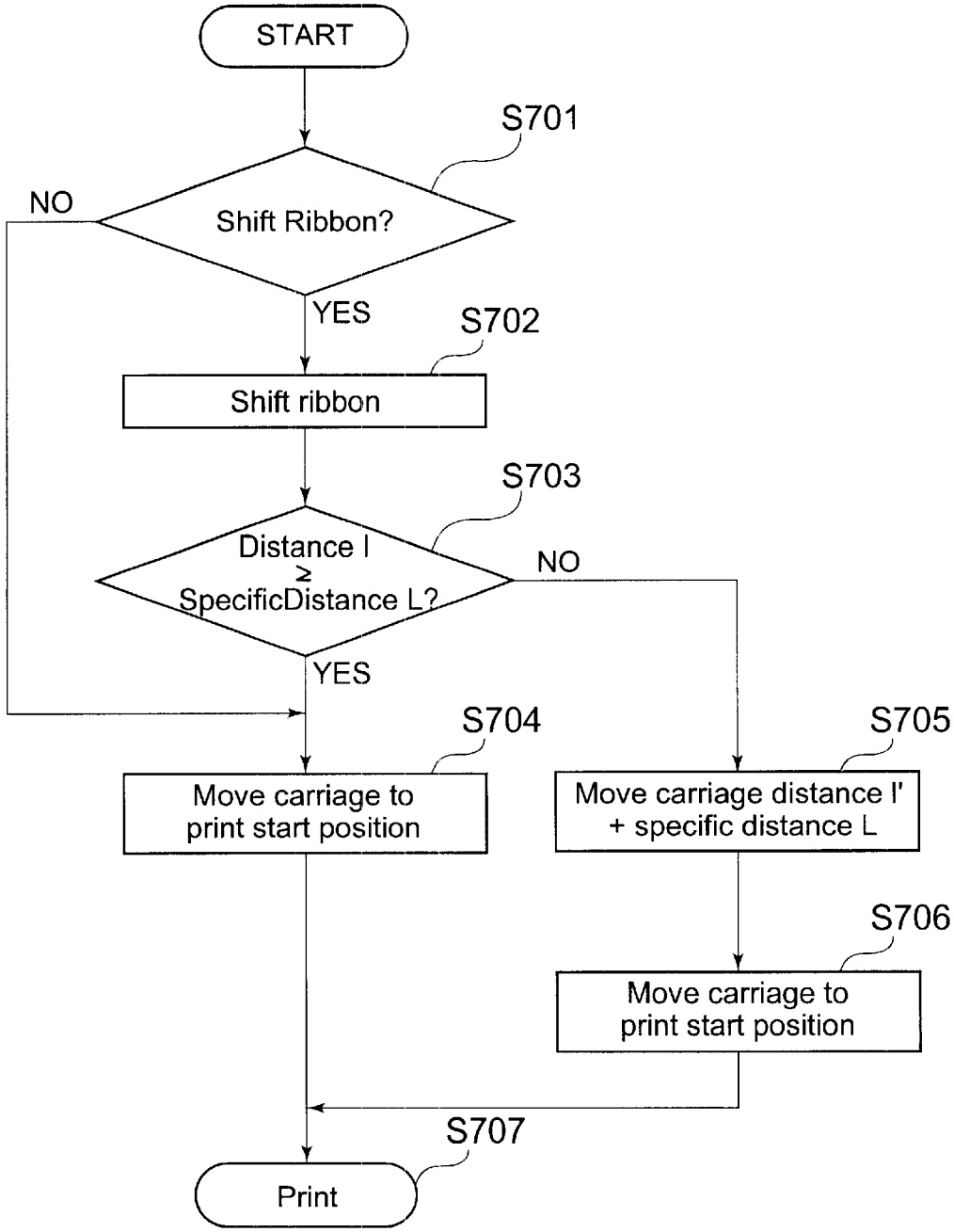
FIG. 7 is a flow chart of a print control procedure in a printer according to the present invention.

FIG. 7 is a flow chart showing a printing control procedure for a printer according to this preferred embodiment of the invention. This flow chart includes control of ink ribbon winding in conjunction with carriage movement. Particular attention will be given to the ink ribbon winding operation accompanying movement the carriage for printing.

When the printer controller (i.e. CPU 61 and the control program stored in ROM 62) receives print data or a print command from a host device by way of interface 65, it first determines whether ink ribbon shifting is necessary (S701). That is, the controller determines the new print color from the received print data or command, and compares this new print color with the old print color stored in the print color buffer of RAM 63. If the controller determines that ink ribbon shifting is necessary (i.e. new color differs from old color), the ink ribbon is shifted, and the new print color is stored in the print color buffer of RAM 63 (S702).

That is, if the new print color and old print color are different, i.e. ink ribbon shifting is necessary (S701, YES), the shift mechanism 30 or shift release mechanism 40 is operated to shift or release carriage shifting, respectively, by moving the carriage to the right or left end, respectively, of the frame outside the print area as described above.

If the new print color and old print color are the same, that is, ink ribbon shifting is not necessary (S701, NO), the carriage is moved to the print start position (S704) and printing commences (S707) without shifting the ink ribbon.

A printer typically has a home position, and carriage movement is performed with reference to this home position. The position of the print head relative to this home position is always known, and the distance and direction of print head movement can therefore be easily determined.

If the ink ribbon is shifted in step S702, the next step is to determine whether ink ribbon winding is necessary (S703). That is, as described above, it is possible for the ink ribbon to be caught on the print head after the ink ribbon is shifted, resulting in the ribbon not being properly shifted and misalignment of the ribbon to the print head. This may be due to a certain amount of slack in the ribbon. If printing is performed with the ribbon caught, there will likely be an undesired printing of the wrong color or a mixing of colors. Ink ribbon winding is therefore controlled to avoid this problem. The ink ribbon is wound a specific distance to take up the slack in the ribbon after shifting the ribbon.

In the present embodiment, after the print color is changed from red to black by operating the release mechanism 40 at the left hand side of the printer, the carriage 16 needs be moved to the right so that the print head may reach the print start position. As explained before, carriage movement to the right is accompanied by an advancing or winding operation of the ink ribbon. Depending on the location of the print start position at which the black color printing is to commence, the winding of the ink ribbon accompanying the required rightward movement of the carriage from its left end position to the print start position may be sufficient or not sufficient to remove any misalignment of the ink ribbon. If it is not sufficient, an extra movement of the carriage to the right is necessary to ensure any misalignment being removed.

On the other hand, after the print color is changed from black to red by operating the shift mechanism 30 at the right hand side of the printer, the carriage needs be moved to the left in order that the print head may reach the print start position. Since carriage movement to the left is not accompanied by ink ribbon winding in the present embodiment, an extra movement of the carriage to the right by a distance causing the ink ribbon to be sufficiently wound so as to remove any misalignment, is always necessary. If the ink ribbon is shifted in step S702, the next step S703 is to determine whether such extra movement of the print head for ink ribbon winding is necessary.

The control method of this preferred embodiment of the invention therefore considers the location of the next print start position to determine whether such extra movement is necessary to provide for a sufficient ink ribbon winding after a color change. This is accomplished by comparing a distance l with a specific distance L, and if distance l is greater than or equal to a specific distance L (S703;YES), moving the carriage directly to the print start position (S704). This distance l is the total distance to the print start position that is accompanied by ink ribbon winding. In this embodiment, ink ribbon winding occurs automatically only when the carriage and print head are moved from left to right. Therefore, if, after the ribbon is shifted (S702), the carriage is to the right of the print start position, and must be moved to the left to reach the start position, the distance l will always be zero since no ribbon winding will occur with the right-to-left carriage movement. The distance l' is the total distance to the print start position and its value is not a function of which direction the carriage would have to move to reach the print start position.

The specific distance L is the amount of carriage movement required to correct the ink ribbon position (e.g. to take up any slack). The specific distance L can be predetermined and set based on the experience of the printer designer or user. It will generally be selected as the smallest distance required to take up any slack and adjust the ribbon in order to correct for misalignment of the ribbon and print head.

As mentioned above, in this exemplary embodiment of the invention the ink ribbon is wound only when the carriage moves to the right. The distance of carriage movement from left-to-right to the print start position is therefore a positive distance value 1. Carriage movement from right-to left to the print start distance is a zero distance value 1. If distance value 1 is greater than or equal to specific distance L, the carriage is moved directly to the print start position in step S704 as this left-to-right carriage movement alone is sufficient to correct for any ink ribbon misalignment problems resulting from ribbon shifting.

If distance l is less than this specific distance L (S703, NO), ink ribbon winding (if any) accompanying the carriage movement will be insufficient to correct ink ribbon problems if the print head is moved directly to the print start position. The carriage is therefore moved (to the left in this embodiment) a distance equal to distance l' plus specific distance L (S705). The carriage is then moved to the print start position (S706) and printing is then performed (S707). This assures that the carriage moves a distance sufficient to wind the ribbon enough for ink ribbon correction.

Printer control according to the present invention as described above thus improves printing throughput by determining from the next print start position whether a separate operation for ink ribbon correction (i.e. winding) is required, and performs this operation only when required.

Figure 8:
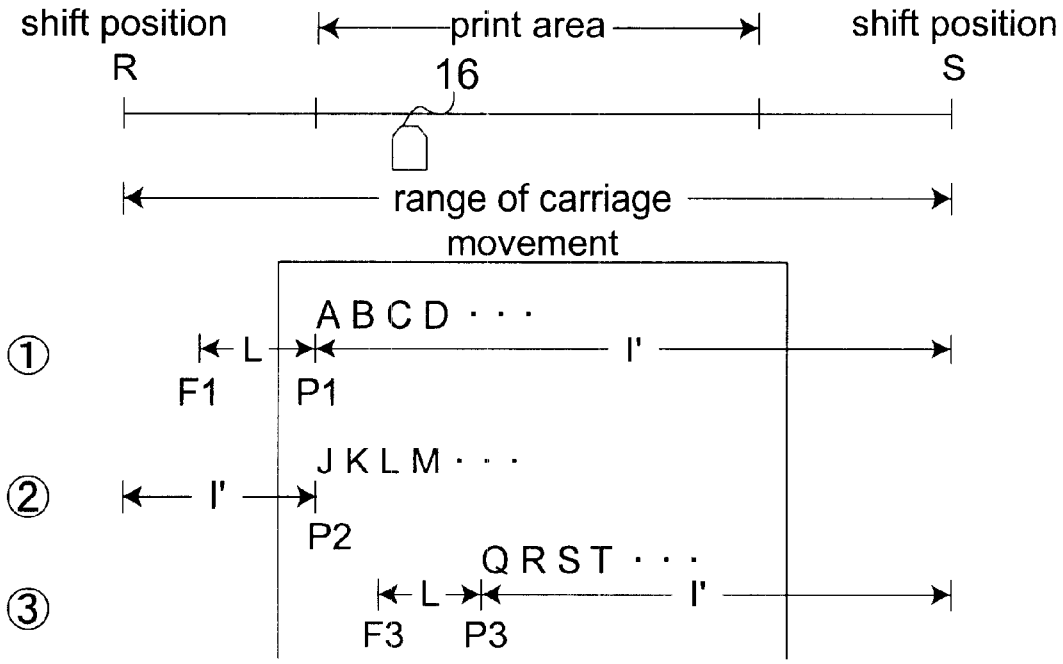
FIG. 8 is used to describe a specific example of printer control according to the process shown in FIG. 7.

A specific example of printer control according to the procedure shown in FIG. 7 is described next below with reference to the examples shown in FIG. 8. FIG. 8 shows three different print samples (samples 1 to 3). The control steps performed before each of these samples is printed are described in order below.

In FIG. 8, the print head 14 on the carriage 16 is able to move throughout the carriage movement area, including the area outside the print area. At shift position S at the right end of the carriage movement area, the carriage is shifted as described above to switch the ink ribbon from black to red. At shift position R at the left end, the ink ribbon is switched from red to black.

In sample 1 in FIG. 8 the ribbon color is shifted at shift position S, and then the text ABCD . . . is printed in red from left to right starting from the beginning of the print area. The movement (distance l') from the current location at shift position S to the print start position P1 is right to left, that is, the direction in which the ribbon is not wound in conjunction with carriage movement. The distance l used in step S703, FIG. 7, is therefore zero.

The process in FIG. 7 therefore moves to step S705 in this case, and the carriage is first moved the distance (distance l'+specific distance L) to the left to a movement point F1 in FIG. 8. The carriage is then moved specific distance L to reach print start position P1 (S706) from where printing text ABCD . . . begins (S707). The ribbon is wound during the movement from the movement point F1 to the print start position P1, and any ribbon positioning problem is thus corrected as described above.

Following printing in sample 1, the text JKLM . . . is printed from left to right in black from the beginning of the print area in sample 2. In this case it is necessary to first move the carriage to shift position R in order to release the ribbon from the red shift position and reset the ribbon to the black ink area before printing begins. The carriage then moves from shift position R to print start position P2 (distance l'), that is, left to right in conjunction with ink ribbon winding. In this case, distance l is equal to distance l' in step S703, FIG. 7. As a result, the control procedure advances to step S704, and the carriage moves right to the print start position P2 only distance l' away. It should be noted that specific distance L is assumed to be shorter than the distance from shift position R to the beginning of the print area in this case. Printing JKLM . . . then begins. This rightward movement of the carriage from the shift position R to print start position P2 is accompanied by ink ribbon winding, and any ribbon positioning problem is again corrected as described above. If, in this example, distance l was less than specific distance L, then the carriage could first be moved to the right a distance L (to provide the required ribbon winding) and then moved back (left) a distance L minus l to the print position. Alternately, the carriage could first be moved to the right a distance l to the print position, then moved back (left) a distance L minus l (to account for the required ribbon winding) and then moved to the print position.

In sample 3 the text QRST . . . is printed in red from left to right from the middle of the print area following sample 2. In this case the carriage must first be moved to shift position S to shift the ink ribbon before printing can begin. Carriage movement from the shift position S to print start position P3 (distance l') is to the left in this case, that is, movement unaccompanied by ink ribbon winding, and distance l in step S703, FIG. 7, is therefore zero. The control process therefore continues to step S705 to move the carriage (distance l'+specific distance L) to the left to a movement point F3 in FIG. 8. The carriage is then moved specific distance L to reach print start position P3 (S706) from where printing text QRST . . . begins (S707). The ribbon is wound during the movement from the movement point F3 to the print start position P3, and any ribbon positioning problem is thus corrected as described above.

In the foregoing description, the ink ribbon is shifted from black to red or vice versa by mechanisms on either far end of the carriage movement. However, in certain printers, the print track of the ink ribbon can be shifted with a dedicated motor and drive mechanism so that shifting can occur at any point along the carriage movement path, rather than only at either end. Controlling carriage movement without ribbon winding is described next with reference to FIG. 9, in which the ribbon is shifted at the current position (O), which is not at the far right or left end of carriage movement. In this example the printing direction D is from left to right with the next print start position P to the right of the current carriage position O as shown in the figure. It should be noted that the ink ribbon is wound in conjunction with the carriage movement in only one direction as described above and that the print track of the ink ribbon is shifted by dedicated drive parts. Further, in the examples shown in FIG. 9, it is assumed that the controller has determined that l is less than L.

Figure 9:
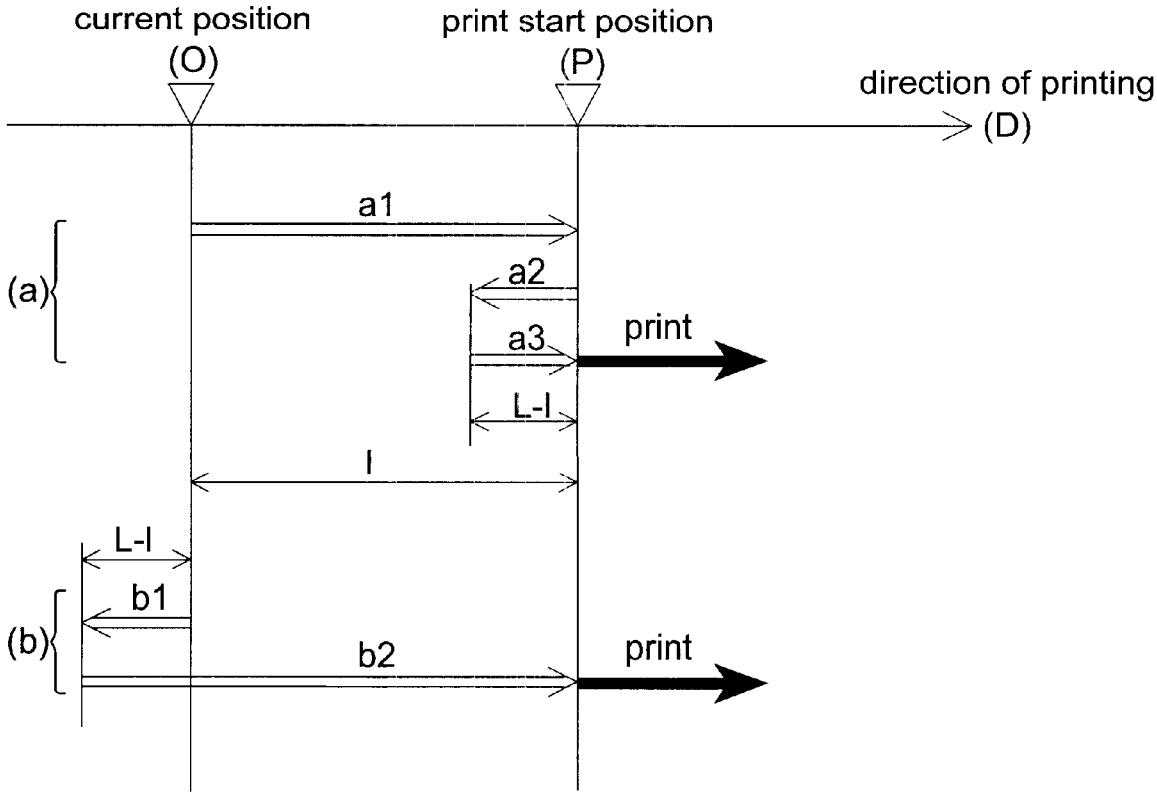
FIG. 9 is used to describe a specific example of print head movement control according to the present invention.

There are two ways to control carriage movement in this case, indicated as (a) and (b) in FIG. 9. With method (a) in FIG. 9 the carriage 16 is first moved right a distance (a1), i.e. distance l, to the print start position. Then it is moved back to the left a distance (a2), i.e. specific distance L minus distance l, to compensate for insufficient ribbon winding.

Then it is moved again to the right in the normal forward direction a distance (a3), i.e. specific distance L minus distance l, to the print start position P. Accordingly, the carriage is moved to the right (twice) and the ribbon is wound at least the required distance L, i.e. L=l+(L−l).

With method (b), the carriage is first moved left a distance (b1), i.e. specific distance L minus distance l, from the current position O to compensate for insufficient ribbon winding. It is then moved forward to the right a distance (b2) to the print start position P. Distance (b2) is equal to specific distance L, i.e. L=(L−l) +l.

As will be evident from FIG. 9, method (a) requires the direction of carriage movement to be changed twice while method (b) requires only one change in direction. Furthermore, because carriage movement generally involves an accelerate, steady speed, decelerate cycle, reducing the number of changes in carriage direction can also improve throughput. It is therefore desirable to determine the direction in which the carriage is made to start from position O in such a way that it reaches the print start position with a minimum number of direction changes after having traveled at least over the distance L in the direction in which the ink ribbon is wound.

FIG. 9 illustrates the situation for the case that the printing direction D from the print start position is to the right. If bi-directional printing is considered, the printing direction from the print start position may also be to the left. Even though not shown in FIG. 9, it will be easily understood, that with the printing direction from right to left the least number of direction changes is achieved as follows: movement from O to the right over distance L, i.e., beyond P, movement by (L−l) to the left to reach P, and start of printing at P to the left. As this example shows, in bi-directional printing the printing direction is another parameter to be taken into account for the decision about the direction of carriage movement from position O.

Although the present invention has been described in connection with the preferred embodiments thereof with reference to the accompanying drawings, the invention shall not be limited thereto and includes such changes and modifications that will be apparent to those skilled in the related art based on the accompanying claims, the present detailed description of the invention, and the related art.

For example, the present invention has been described with reference to an exemplary embodiment in which the shift mechanism switches between two print tracks on an ink ribbon. It will be obvious, however, that the present invention can also be adapted to a shift mechanism capable of switching between three or more print tracks.

Furthermore, the present invention shall not be limited to a configuration in which the carriage drives the shift mechanism. More specifically, a motor, solenoid, or other dedicated drive parts can be alternatively disposed for shifting the print track such that the print head can be moved to the next print start position while the ink ribbon is shifted to a desired print track.

The present preferred embodiment of the invention has also been described using a configuration in which the ink ribbon is wound in conjunction with carriage movement in only one direction, but can obviously be adapted to a configuration in which the ink ribbon is wound in both directions of carriage movement.

Furthermore, the ink ribbon winding mechanism shall not be limited to the design described above, and can be any configuration whereby the ink ribbon is wound in conjunction with carriage movement.

It should be further noted that based on the concept of the preferred embodiment described above, various methods for improving print throughput by eliminating unnecessary print head movement and moving to the next print start position in the least amount of time can be devised based on the specific printer configuration, that is, the ink ribbon shift mechanism, ink ribbon winding mechanism, and whether the printer prints in one direction or two directions.

With a printer and printer control method according to the present invention a non-printing winding mode is used only when the ink ribbon will not be wound a specific distance in conjunction with normal print head movement. Unnecessary print head movement is thus eliminated, and a reduction in throughput accompanying the resulting ink ribbon switching can thus be minimized.

Furthermore, the print head can be moved in the least possible time to the next print start position when the print head is moved in a non-printing winding mode, and print throughput can be further improved, in a printer and printer control according to the present invention whereby the position of the print head after the non-printing winding mode movement is determined according to the next print start position and print direction.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A control method for a printer that includes a print head that moves relative to a print medium, an ink ribbon disposed in front of said print head and along a direction of movement of said print head, said ink ribbon being wound in a winding direction in conjunction with print head movement and having a plurality of ink colors arranged substantially orthogonally to said winding direction, and a switching mechanism that changes a relative position between said print head and said ink ribbon in a direction orthogonal to the ink ribbon winding direction; said method comprising:

changing a relative position between said print head and said ink ribbon in a direction orthogonal to the ink ribbon winding direction;

comparing a distance l to a specific distance L, said distance l being a distance of print head movement to a next print start position in conjunction with ink ribbon winding, and said specific distance L being a distance for correcting ink ribbon offset to said print head; and moving said print head at least a distance L−l in a non-printing winding mode if said distance l is less than specific distance L, said non-printing winding mode including moving the print head while winding the ink ribbon without driving the print head to print.

2. A printer control method for a printer that prints using an ink ribbon having a plurality of print tracks, comprising:

printing on a print medium with a print head using said ink ribbon;

bi-directionally moving said print head in a direction across a print medium transportation direction;

winding said ink ribbon in conjunction with print head movement;

changing a relative position between a print track and said print head;

after or concurrently with said changing step, determining whether a distance l is at least equal to a predetermined specific distance L, said distance l being a distance of print head movement to a next print start position in conjunction with ink ribbon winding; and moving said print head in a non-printing winding mode at least a distance L–l to wind said ink ribbon when said print head movement distance l is less than said specific distance L as determined in said determining step, said non-printing winding mode including moving the print head while winding the ink ribbon without driving the print head to print.

3. A printer control method as in claim 2, further comprising determining a non-printing winding mode distance and direction based on a next print start position and print direction.

4. A printer control method as described in claim 2, further comprising determining the position of the print head after said a print head movement by a distance of at least L–l in the non-printing winding mode in consideration of the location of said next print start position such that the print head reaches the next print start position with the fewest possible number of direction changes of the print head movement.

5. A printer control method as described in claim 2, further comprising controlling the sequence of movements of the print head from its current position to said next print start position in consideration of the relative locations of said current position and said next print start position such that the print head reaches the next print start position with the fewest possible number of direction changes of the print head movement.

6. A printer control method as described in claim 5, in case of bi-directional printing the printing direction in which the print head prints from said next print start position is also taken into consideration for the control of said sequence of movements so as to minimize the number of direction changes of the print head movement.

7. A data storage medium readable by a machine embodying a program of instructions executable by said machine to perform a method of controlling a printer that includes a print head that moves relative to a print medium, an ink ribbon disposed in front of said print head and along a direction of movement of said print head, said ink ribbon being wound in a winding direction in conjunction with print head movement and having a plurality of ink colors arranged substantially orthogonally to said winding direction, and a switching mechanism that changes a relative position between said print head and said ink ribbon in a direction orthogonal to the ink ribbon winding direction; said control method comprising:

changing a relative position between said print head said ink ribbon in a direction orthogonal to the ink ribbon winding direction;

comparing a distance l to a specific distance L, said distance l being a distance of print head movement to a next print start position in conjunction with ink ribbon winding, and said specific distance L being a distance for correcting ink ribbon offset to said print head; and moving said print head at least a distance L–l in a non-printing winding mode if said distance l is less than specific distance L, said non-printing winding mode including moving the print head while winding the ink ribbon without driving the print head to print.

8. A data storage medium readable by a machine embodying a program of instructions executable by said machine to perform a method of controlling a printer that prints using an ink ribbon having a plurality of print tracks, the control method comprising:

printing on a print medium with a print head using said ink ribbon;

bidirectionally moving said print head in a direction across a print medium transportation direction;

winding said ink ribbon in conjunction with print head movement;

changing a relative position between a print track and said print head;

after or concurrently with said changing step, determining whether a distance l is at least equal to a predetermined specific distance L, said distance l being a distance of print head movement to a next print start position in conjunction with ink ribbon winding; and moving said print head in a non-printing winding mode at least a distance L–l to wind said ink ribbon when said print head movement distance l is less than said specific distance L as determined in said determining step, said non-printing winding mode including moving the print head while winding the ink ribbon without driving the print head to print.

9. A data storage medium as in claim 8, wherein the control method further comprises determining a non-printing winding mode distance and direction based on a next print start position and print direction.

10. A data storage medium as described in claim 8, further comprising determining the position of the print head after said a print head movement by a distance of at least L–l in the non-printing winding mode in consideration of the location of said next print start position such that the print head reaches the next print start position with the fewest possible number of direction changes of the print head movement.

11. A data storage medium as described in claim 8, further comprising controlling the sequence of movements of the print head from its current position to said next print start position in consideration of the relative locations of said current position and said next print start position such that the print head reaches the next print start position with the fewest possible number of direction changes of the print head movement.

12. A data storage medium as described in claim 11, in case of bi-directional printing the printing direction in which the print head prints from said next print start position is also taken into consideration for the control of said sequence of movements so as to minimize the number of direction changes of the print head movement.

* * * * *